US007726716B2

(12) United States Patent
Shuttleworth

(10) Patent No.: US 7,726,716 B2
(45) Date of Patent: Jun. 1, 2010

(54) TRACTION DEVICE FOR DRAWING AN OBJECT INTO ITS INTERIOR

(76) Inventor: Gary Shuttleworth, 15 Booth Drive, Ashbourne, Derbyshire DE6 1SZ (GB)

( * ) Notice: Subject to any disclaimer, the term of this patent is extended or adjusted under 35 U.S.C. 154(b) by 898 days.

(21) Appl. No.: 11/320,256

(22) Filed: Dec. 27, 2005

(65) Prior Publication Data

US 2006/0099066 A1 May 11, 2006

Related U.S. Application Data

(63) Continuation-in-part of application No. 10/481,533, filed as application No. PCT/GB02/02923 on Jun. 25, 2002.

(30) Foreign Application Priority Data

Jun. 27, 2001 (GB) ..... 0115640.5

(51) Int. Cl.
*B25J 15/00* (2006.01)

(52) U.S. Cl. ..... 294/86.4

(58) Field of Classification Search ..... 294/86.4; 901/30, 31

See application file for complete search history.

(56) References Cited

U.S. PATENT DOCUMENTS

| | | | | |
|---|---|---|---|---|
| 2,763,507 | A | 9/1956 | Haley | |
| 3,347,545 | A * | 10/1967 | Nichols | 472/51 |
| 3,482,718 | A * | 12/1969 | Moriarty | 414/412 |
| 4,078,838 | A | 3/1978 | Nadratowski | |
| 4,469,100 | A * | 9/1984 | Hardwick | 606/127 |
| 4,654,019 | A | 3/1987 | Waggener | |
| 4,964,188 | A | 10/1990 | Olson | |
| 5,083,824 | A | 1/1992 | Sato et al. | |
| 5,171,305 | A | 12/1992 | Schickling et al. | |
| 6,846,029 | B1 * | 1/2005 | Ragner et al. | 294/86.4 |
| 6,994,387 | B1 * | 2/2006 | Ragner et al. | 294/86.4 |
| 2003/0160470 | A1 * | 8/2003 | Marshall | 294/86.4 |

FOREIGN PATENT DOCUMENTS

| | | |
|---|---|---|
| GB | 2162739 | 2/1986 |
| WO | 88/01924 | 3/1988 |
| WO | 9428252 | 12/1994 |

* cited by examiner

*Primary Examiner*—Paul T Chin
(74) *Attorney, Agent, or Firm*—Chernoff, Vilhauer, McClung & Stenzel

(57) ABSTRACT

A traction device (102) for use in picking or gripping or packaging objects. The traction device (102) draws an object into its interior. It comprises a surface (16) of deformable material, shaped substantially as a tube with an end portion turned inside-out, forming an opening to an interior, and an actuator (6) for moving the surface to draw the object into the interior. The surface of deformable material may be a part of a fluid-filled toroid body (10). The traction device can be used in combination with a bag to bag an object.

15 Claims, 12 Drawing Sheets

TRACTION DEVICE FOR DRAWING AN OBJECT INTO ITS INTERIOR

This application is being filed as a continuation-in-part of U.S. patent application Ser. No. 10/481,533 filed Dec. 19, 2003 now abandoned, which was filed as a national stage application under 35 USC 371 based on International Application No. PCT/GB2002/02923 filed Jun. 25, 2002, claiming priority under 35 USC 119 of United Kingdom Patent Application No. 0115640.5 filed Jun. 27, 2001.

The present invention relates to a traction device which can be used for picking or gripping or bagging or packaging objects.

Current picking/gripping aids are only suitable for picking/gripping a limited range of objects.

It would be desirable to provide a device which can pick/grip a wide range of objects.

It would be desirable to prevent a user of the device coming into contact with the object, and it would also be desirable to be able to prevent the device itself coming into contact with the object.

In the following, the term "toroid" is used to designate a shape approximating to that generated by a closed curve rotated about, but not intersecting, an axis in its own plane. The closed curve may or may not contain the axis.

According to one aspect of the present invention there is provided a traction device, for drawing an object into its interior, comprising: a surface of deformable material, shaped as a tube with an end portion turned inside-out, forming an opening to an interior and an actuator for moving the surface to draw the object into the interior.

Preferably, the tubular portion forms the interior and the portion at which the surface turns inside out forms the opening. The traction device is a friction traction device which uses friction to draw an object into its interior. There is preferably a support for supporting the surface. The support may comprise a skeleton to which the deformable material is attached or it may be comprised of a fluid located adjacent the surface. The fluid may be a pressurised gas or a liquid. There is preferably some means for maintaining tension in the surface as it is moved. The body may contain fluid located adjacent the surface which tensions the surface. The traction device may be used to draw multiple objects sequentially into its interior as the opening will be present after an object has been drawn wholly into the interior.

The traction device may comprise a tube of deformable material with an end portion turned inside-out. The tube is preferably cylindrical. The diameter of the tube is preferably dimensioned to exceed the maximum width of the object which the traction device is designed to pick up. Both end portions of the tube may be turned inside out and joined to form a toroid. Alternatively, the traction device may comprise a toroid made from deformable material and providing the surface. The toroid may be is filled with fluid.

The toroid may be filled entirely with fluid. The fluid may be a pressurised gas or a liquid. There is preferably an inlet, which allows fluid to be added or removed. The fluid may be changed depending upon the ambient environment in which the traction device is used.

The actuator is coupled to the surface but may be detachable. The actuator may be attached or attachable to pull the surface. For example, if the surface is provided by a toroid, the actuator may be attached or attachable to the interior passage of the toroid. The actuator may be attached or attachable to push the surface. For example, if the surface is provided by a toroid, the actuator may be attached or attachable to the exterior of the toroid.

Preferably, the device includes a plurality of projecting members, which project from the surface to engage the object and provide additional picking/gripping/friction. Preferably, each projecting member is arranged to correspond with another projecting member as the surface is moved into the interior.

Preferably, the projecting members are arranged in a plurality of sets. Preferably, each set includes a plurality of projecting members which correspond together as the surface is moved into the interior. Preferably, each set includes substantially the same number of projecting members. Preferably, the sets of projecting members are spaced apart from each other along the surface.

Preferably, the projecting members of each set are spaced radially around the surface, and may be spaced equally. Preferably, each projecting member of each set comes into contact with at least one other member of the same set as the surface moves into the interior.

Preferably, each projecting member is conical in shape, tapering from the surface to a tip. The tip may be pointed or rounded. Alternatively, each projecting member may be pyramidal, cylindrical, forked, L-shaped or T-shaped.

Preferably, as the surface moves into the interior, it deforms to form a plurality of creases. Preferably, the device is arranged so that in the interior, each of the projecting members extends towards one of the creases, and may be received in one of the creases.

Preferably, the surface material includes a plurality of thicker regions and thinner regions, and the location of the creases may be associated with the location of the thinner regions. Preferably, the thinner regions extend along the surface material. Preferably, the projecting members are substantially aligned in rows along the surface. Preferably the rows of projecting members and the thinner regions are located alternately radially around the surface, and may be spaced substantially equidistantly from each other so that the creases locate substantially equidistantly between the rows of projecting members.

Preferably, in the thinner regions, the surface material is approximately half the thickness of the surface material in the thicker regions.

Preferably, the projecting members may be in the form of fingers, and may project more than 5 mm from the surface. Preferably, the projecting members project less than 40 mm from the surface.

Alternatively, the projecting members may be in the form of surface irregularities such as bumps or ribs, and may project less than 5 mm from the surface.

According to another aspect of the invention there is provided a deformable bag for use with a traction device formed from a water impermeable material and sized to fit, snugly, inside out, over the opening such that as the surface at the opening moves into the interior it draws the object into the bag and moves the bagged object into the interior. The deformable bag may have an exterior surface having surface irregularities which, in use, provide a frictional force between the exterior said surface of the bag and the surface of the traction device object. The bag may comprise adhesive so that when the traction device draws a bagged object into its interior, the bag self-seals.

According to another aspect of the invention there is provided a traction device, for drawing an object at least partially into its interior, comprising: a body having a length and comprising an opening at one end of its length, an interior accessible through the opening, a first flexible movable surface portion extending lengthwise at least from the interior to the opening and at least a second flexible movable surface portion extending lengthwise at least from the interior to the opening, wherein the first and second surface portions, as they extend from the interior diverge and form the opening; and an actuator for moving the first and second flexible movable surface portions at the opening together into the interior.

There is preferably a support for supporting the first and second flexible movable surface portions. The support may comprise a skeleton to which the deformable material is attached or it may be comprised of a fluid located adjacent the first and second flexible surface portions. The fluid may be a pressurised gas or a liquid. There is preferably some means for maintaining tension in the first and second flexible surface portions as they are moved. The body may contain fluid located adjacent the first and second flexible surface portions which tensions the first and second flexible surface portions. The first flexible movable portion and the second flexible movable surface portion may be portions of one surface of deformable material. The traction device may be used to draw multiple objects sequentially into its interior as the opening is present after an object has been drawn wholly into the interior. The first and second flexible movable surface portions preferably have surface irregularities which, in use, provide a frictional force between an object and the first and second movable surface portions.

The body may comprise a tube of deformable material where the first and second movable surface portions are portions of a surface of the tube. The tube is preferably cylindrical. The diameter of the tube may be dimensioned to exceed the maximum width of the object which the traction device is designed to pick up. The first and second movable surface portions may be portions of an interior surface of the tube, where an end portion of the tube is turned inside out. Both end portions of the tube may be turned inside out and joined to form a toroid. Alternatively, the body may comprise a toroid made from deformable material, the exterior surface of the toroid providing the first and second flexible surface portions. The toroid may be filled with fluid.

The toroid may be filled entirely with fluid. The fluid may be a pressurised gas or a liquid. There is preferably an inlet, which allows fluid to be added or removed. The density of the liquid used may be changed depending upon the ambient environment.

The actuator may be detachable. The actuator may be attached or attachable to the first and second flexible surface portions to pull them together. For example, if the first and second flexible surface portions are provided by a toroid, the actuator may be attached or attachable to the interior of the toroid. The actuator may be attached or attachable to the first and second flexible surface portions to push them. For example, if the first and second movable surface portions are portions of a surface of the tube are provided by a toroid, the actuator may be attached or attachable to the exterior of the toroid.

According to another aspect of the invention, there is provided a deformable bag for use with a traction device as claimed in any preceding claim formed from a water impermeable material and sized to fit, snugly, inside out, onto the body and cover the opening such that as the first and second flexible movable surface portions at the opening move together into the interior they draw the object into the bag and move the bagged object into the interior. An exterior surface of the bag may have surface irregularities which, in use, provide a frictional force between the exterior said surface of the bag and the first and second movable surface portions of the traction device object. The bag may comprise adhesive so that when the traction device draws a bagged object into its interior, the bag self-seals.

According to a further aspect of the present invention there is provided a deformable bag, for use with a friction traction device, sized to fit, inside out, over the opening of the traction device and comprising material on the exterior a surface of the bag having an irregular surface which, in use, provides friction between the exterior said surface of the bag and the traction device object.

The traction device and bag may be used to collect animal faeces. The traction device may be used as a medical prosthesis.

According to another aspect of the invention there is provided a system for packaging an object comprising: an air filled body comprising deformable material and having a substantially toroidal shape with an opening to the interior of the body; and an attachable/detachable actuator for pulling the deformable material to draw an object through the opening into the interior of the body. Another aspect of the invention relates to a packaged object comprising an object housed in the interior of an air filled toroid body. A further aspect of the invention relates to a method of packaging an object comprising the steps of: a) providing an air filled body comprising deformable material and having a substantially toroidal shape with an opening to the interior of the body; b) placing the opening of the body over the object; and c) moving the deformable material to draw the object into the interior.

According to another aspect of the invention there is provided a method of picking, gripping or packaging an object comprising the steps of: a) providing a body with a surface, shaped as a tube with an end portion turned inside-out, forming an opening to the interior of the body; b) placing the opening of the body over the object so that the object touches the surface; and c) moving the surface to draw the object into the interior. This method may be adapted to bag faeces by, before step b), placing a bag, inside out, over the body do that it covers the opening.

According to another aspect of the present invention there is provided a method of manufacturing a traction device comprising the steps of: forming a body by turning both the end portions of a tube of deformable material inside-out and joining the ends; filling the body with fluid; and attaching an actuator to the body.

According to a final aspect of the present invention there is provided a traction device, for drawing an object into its interior, comprising: a toroid body of deformable material having an opening to the interior and an actuator for rolling the surface of the toroid. The toroid body preferably comprises fluid over which the surface rolls.

For a better understanding of the present invention reference will now be made by way of example only to the accompanying drawings in which.

FIGS. 5*a*, 5*b*, 5*c*, 5*d* and 5*e* show a traction device being used to bag an object; and FIGS. 6*a*, 6*b*, 6*c* and 6*d* illustrate the manufacture of a portion of the traction device.

Figure 7:
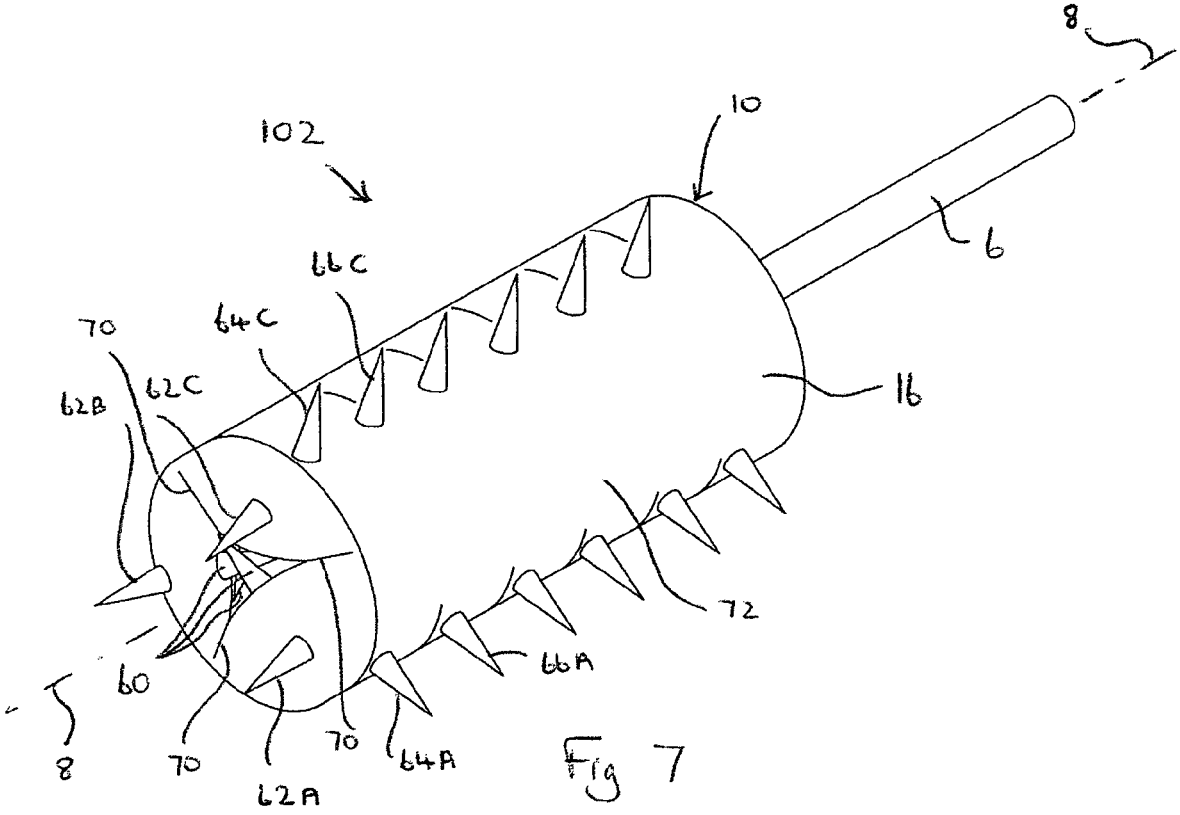
Figure 8:
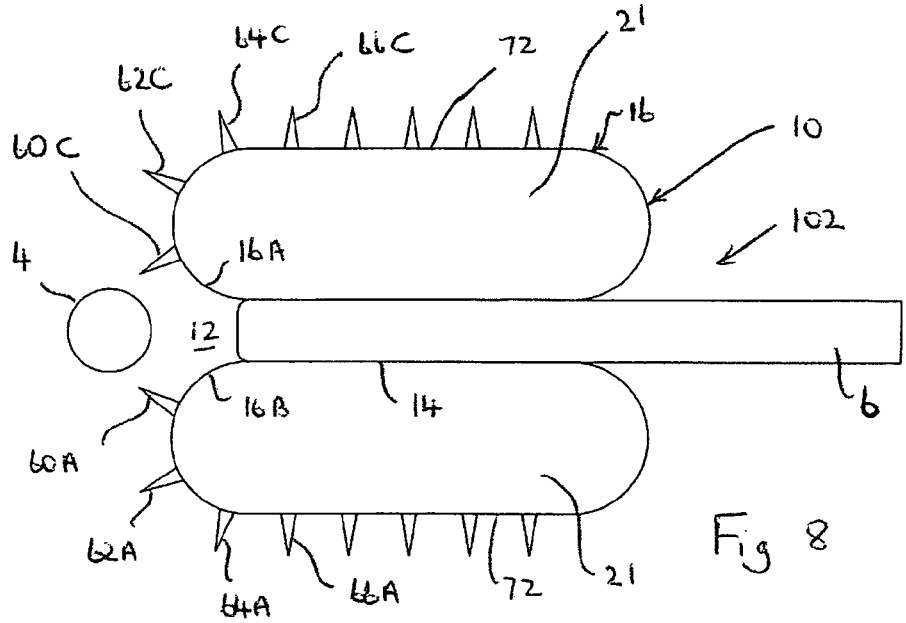
Figure 9:
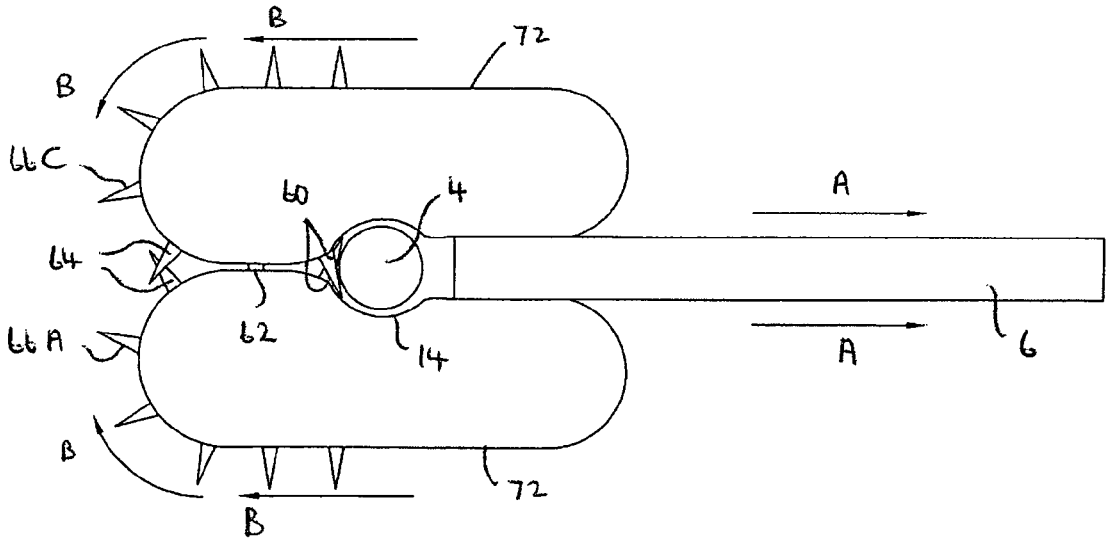
Figure 10:
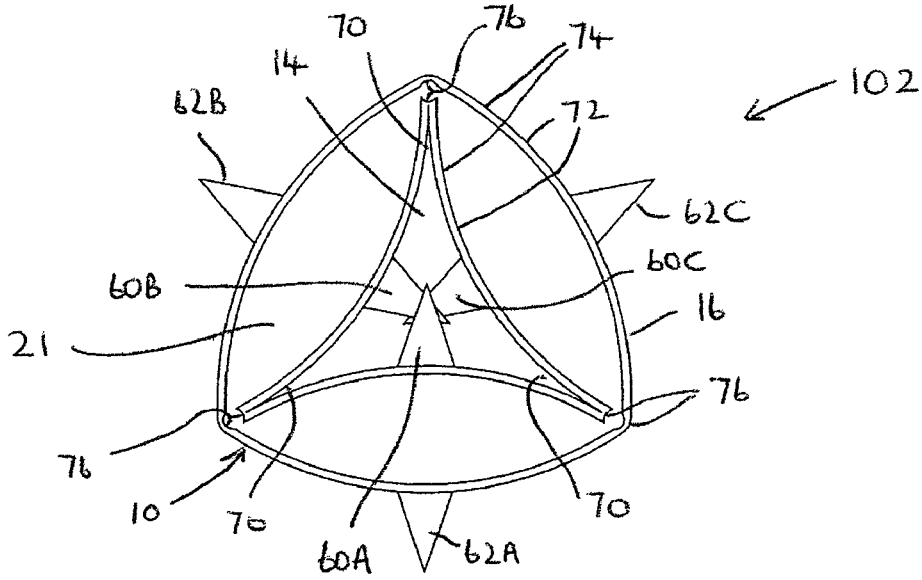
Figure 11:
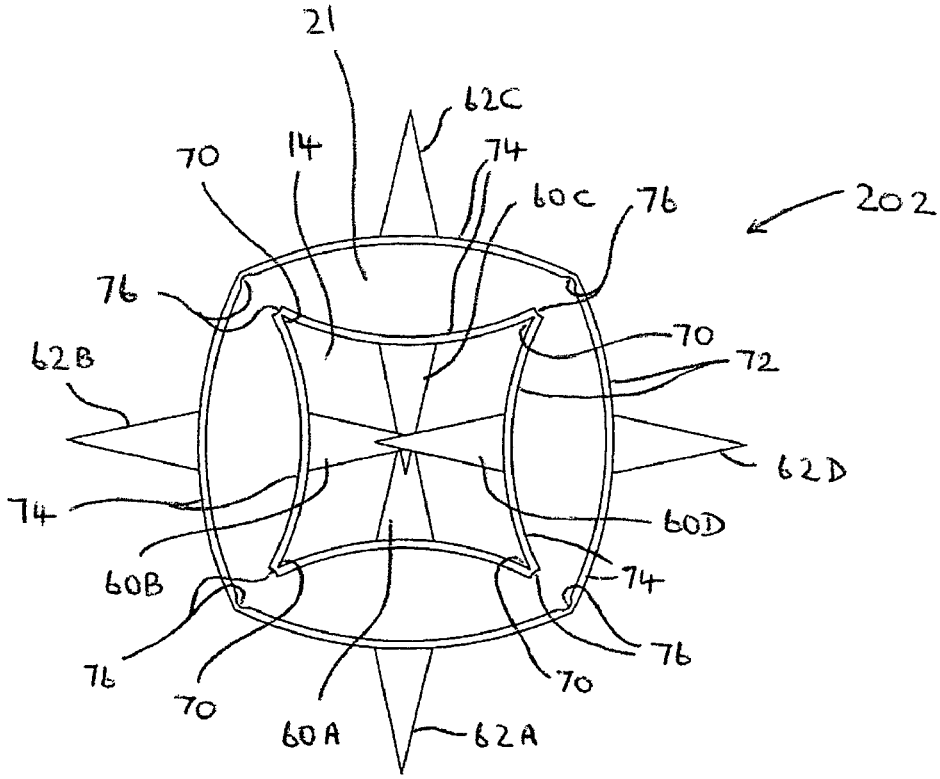
Figure 12:
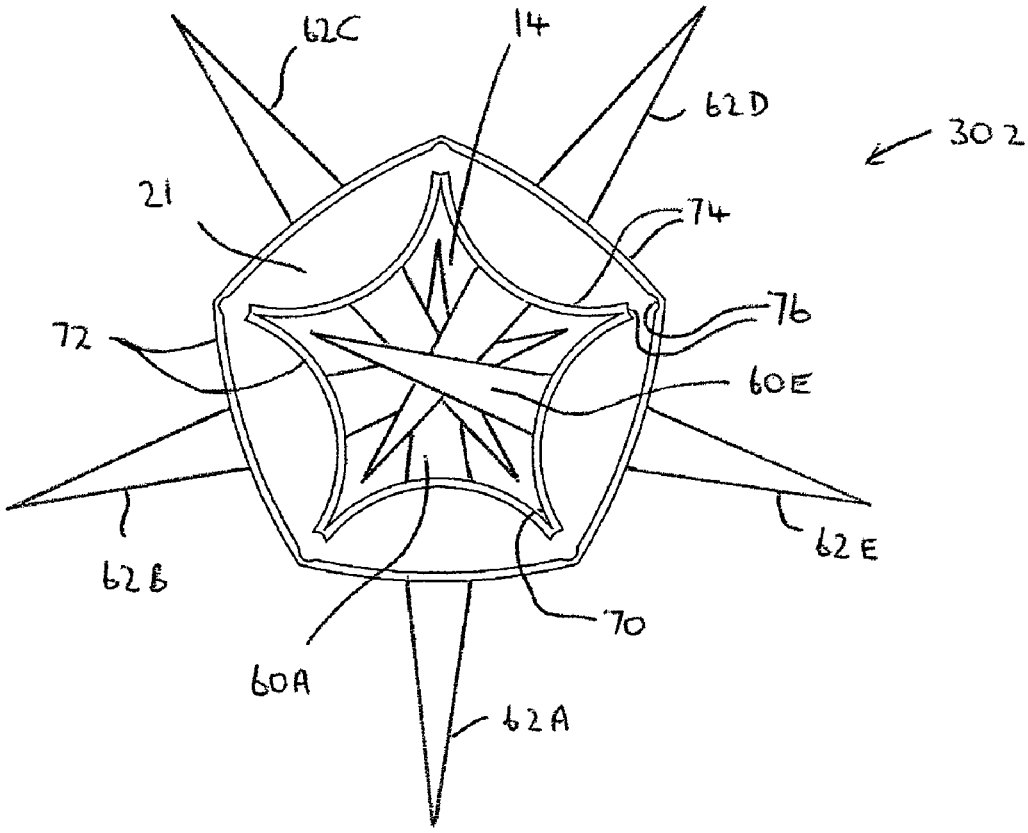
Figure 13:
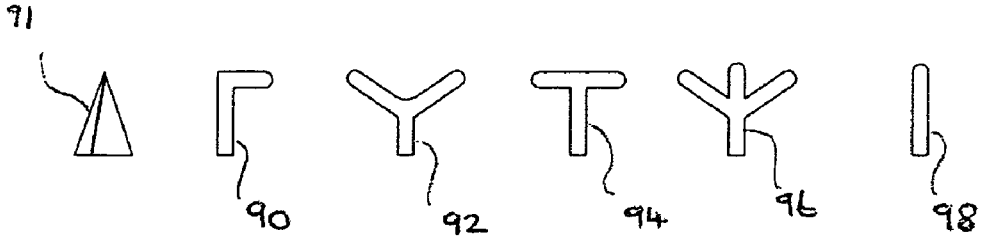
Figure 14A:
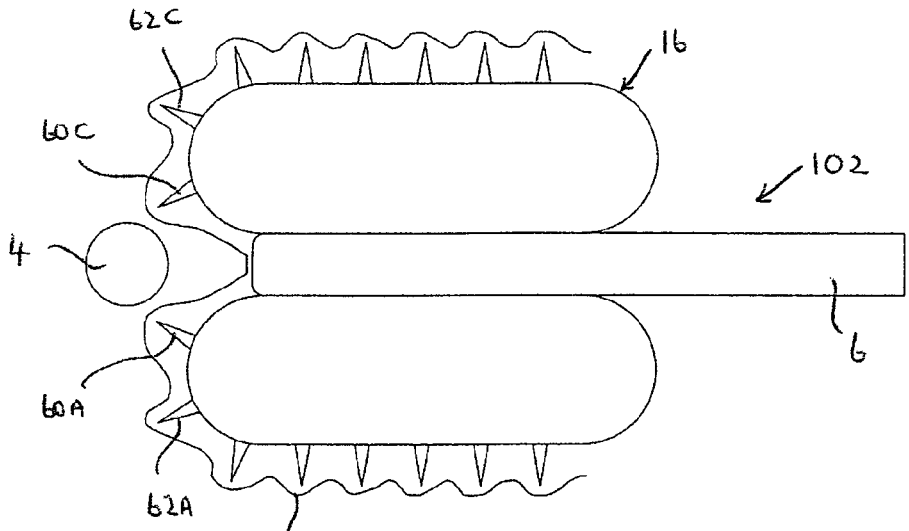
Figure 14B:
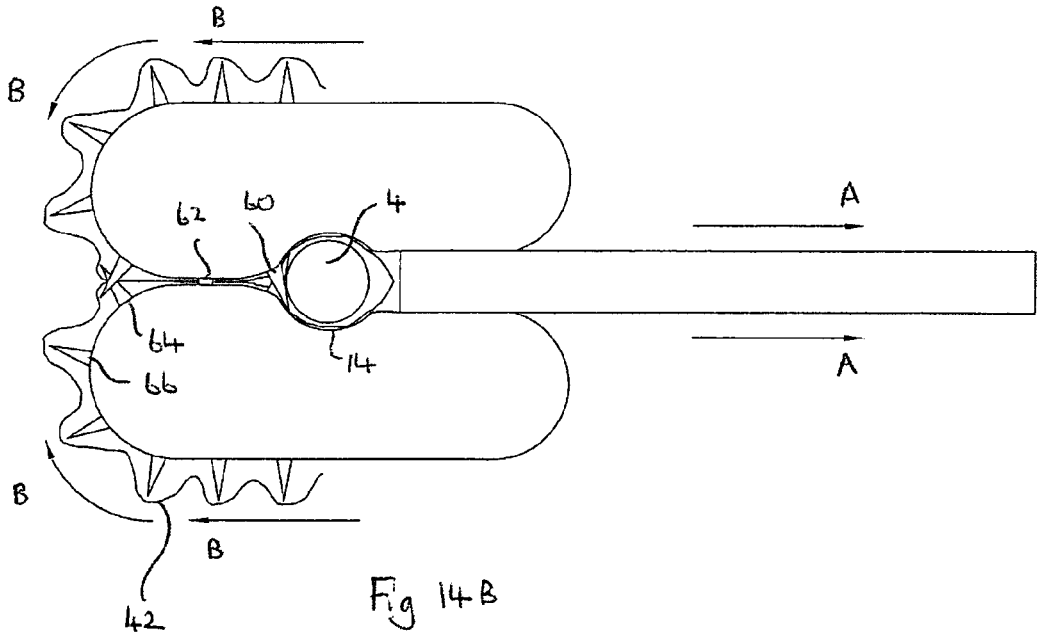
Figure 14C:
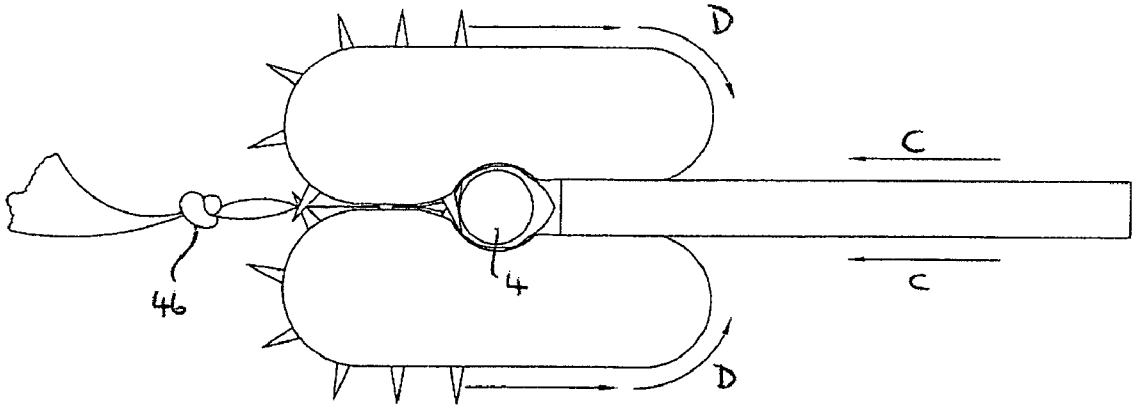
Figure 14D:
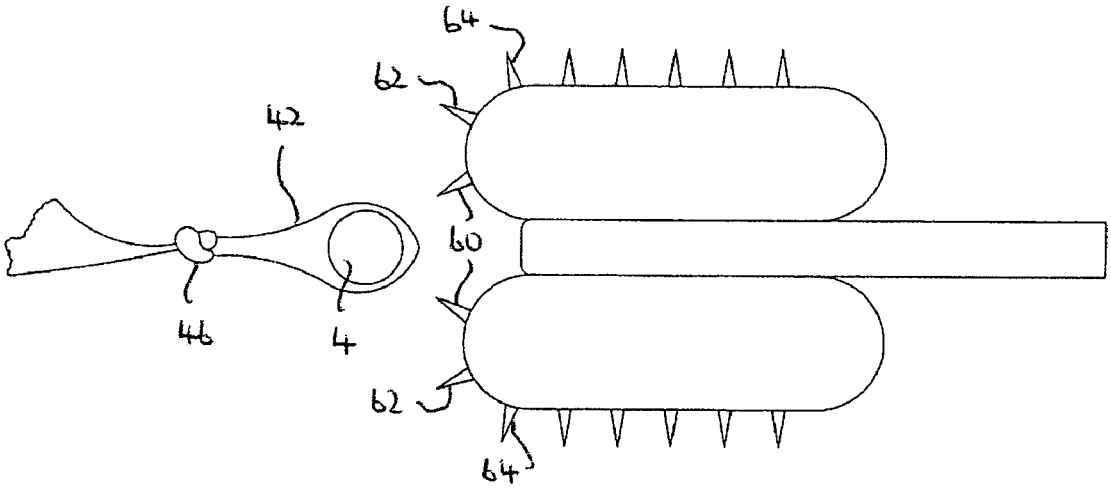
Figure 15:
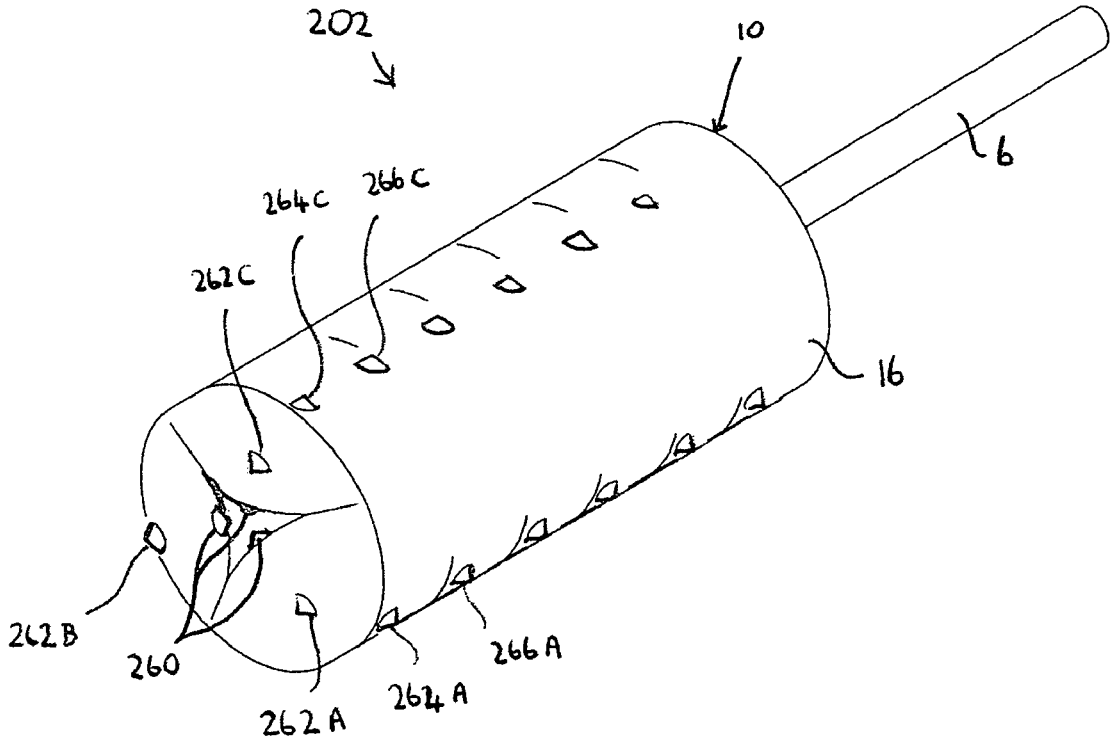

FIG. 7 is a perspective view of another traction device according to the invention;

FIG. 8 is a cross-section of the traction device of FIG. 7, primed for use;

FIG. 9 is a cross-section of the traction device of FIGS. 7 and 8 in use;

FIG. 10 is a partial cross-sectional and end view from one end of the traction device of FIGS. 7 to 9;

FIG. 11 is a partial cross-sectional and end view from one end of another traction device;

FIG. 12 is a partial cross-sectional and end end view from one end of another traction device;

FIG. 13 shows side views of possible forms of projecting members;

FIGS. 14A-14D are cross-sectional views of the traction device of FIGS. 7 to 10, being used to bag an object; and FIG. 15 is a perspective view of another traction device according to the invention.

Figure 1:
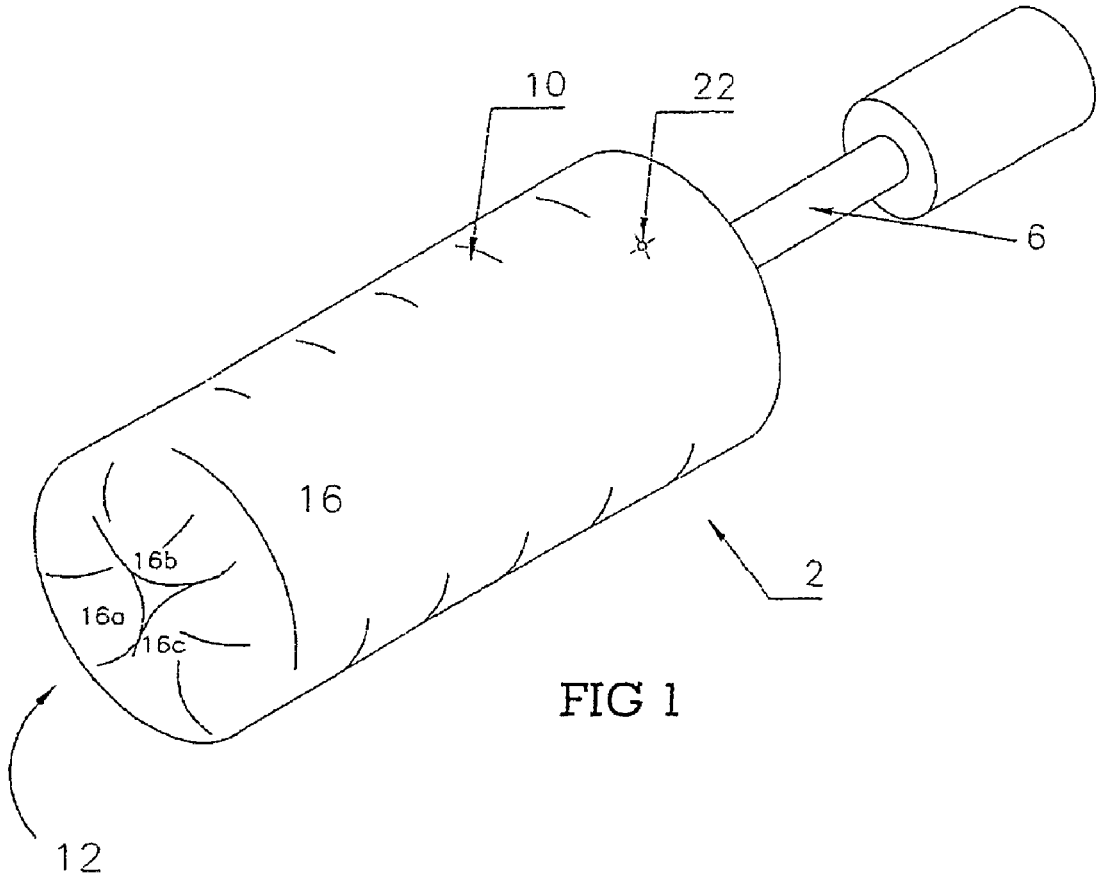
FIG. 1 shows a perspective view of a traction device.
Figure 2:
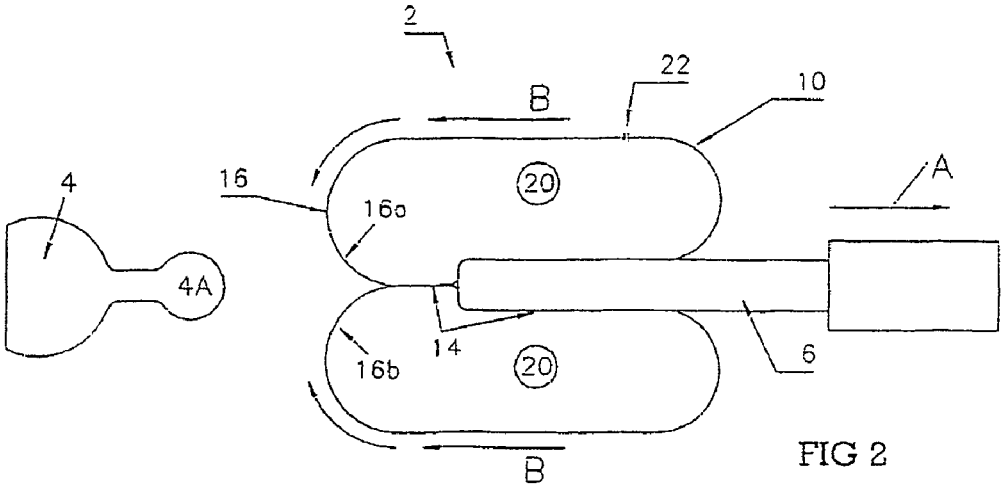
FIG. 2 shows a cross-section of a traction device, primed for use.
Figure 3:
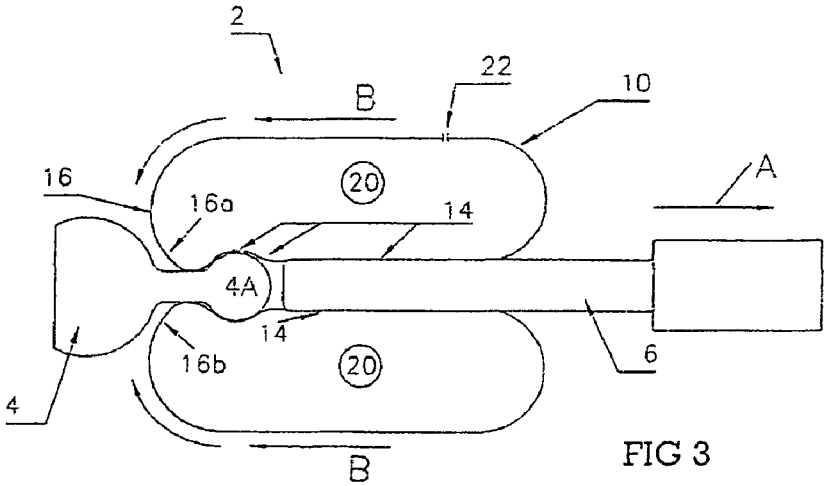
FIG. 3 shows a traction device in use.

Referring to FIGS. 1 to 3, there is illustrated a traction device 2 for use in picking, gripping or packaging an object 4. In the example of FIGS. 1 to 3, the object 4 is irregular and the traction device 2 is used to pick up and grip the object 4.

The traction device comprises a toroid body 10 and an actuator 6. The toroid body 10 is elongate and has an opening 12 at one end which gives access to an interior passage 14 of the toroid body 10. The toroid body 10 is formed from elastically/resiliently deformable material. The deformable material is preferably a flexible polymer (e.g. natural rubber), but could be made from other impermeable material/materials with a suitably high coefficient of friction.

The toroid body 10 has a continuous surface 16. Opposing portions 16*a*, 16*b* and 16*c* of the surface 16 diverge from each other to form the opening 12 and run substantially parallel to each other to form the interior passage 14. The surface 16 in this example is shown as smooth but in other embodiments it may have projecting members in the form of surface irregularities, such as bumps or ribs, for increasing the coefficient of friction of the surface 16, as will be described further below in relation to FIG. 15, or projecting members in the form of fingers, as will be described further below in relation to FIGS. 7 to 14.

The toroid body 10 has an internal cavity 21 formed by the surface 16, which is filled with fluid 20. The fluid 20 supports and tensions the surface 16 of the toroid body 10. Preferably, the toroid body 10 is entirely filled with fluid 20. There are, however, other alternatives for supporting and tensioning the surface 16. One alternative is to provide a resiliently flexible skeleton comprising supporting strips in the internal cavity of the toroid body 10 to which the deformable material defining surface 16 is attached. Another alternative, is to provide one or more fluid impermeable bodies inside the toroid body 10 with fluid filling the gaps between the fluid impermeable bodies and deformable material defining the surface 16.

Liquid or pressurised gas is used as the fluid 20. An inlet 22 is provided through the surface 16 of the toroid body 10. This allows the pressure of the gas to be varied and the fluid to be changed. The density of the fluid used may be varied to make the traction device 2 neutrally buoyant in an underwater environment. For example, if the traction device 2 is used in a marine environment the toroid body 10 may be filled with saline solution. However, if the traction device 2 is used in a fresh water environment, the toroid body 10 may be filled with fresh water.

The actuator 6, which in this example is a hollow rod, is coupled to the surface 16 where it forms the interior passage 14 of the toroid body 10. The actuator 6 may be physically attached to the surface 16 where it forms the interior passage 14. Alternatively, the actuator 6 may be coupled by frictional forces between the surface 16 and the actuator 6.

The operation of the traction device 2 will now be described with reference to FIGS. 2 and 3. The traction device 2 is brought towards the object 4 until the diverging opposing surface portions 16*a*, 16*b* and 16*c* at the opening 12 touch the surface of the object 4. As the actuator 6 is drawn away from the object 4 as indicated by arrow A in FIG. 2 and the exterior surface of the toroid body 10 is pushed by hand towards the object 4, as indicated by arrow B, the surface 16 of the toroid body 10 rolls around the supporting fluid 20 and draws the object 4 into the interior passage 14 as illustrated in FIG. 3. As the opposing surface portions 16*a*, 16*b* and 16*c* at the opening 12 are drawn inwards and upwards into the interior passage 14 of the toroid body 10, they grip the object 4 and pull it, at least partially, into the interior passage 14. The surface 16 defining the interior passage 14 conforms to the shape of the object 4 and the traction device 2 grips the object 4 using a combination of friction between the object 4 and the surface 16 and pressure on the object from the fluid 20 and/or the elastic deformation of the surface 16 adjacent the object 4. Thus the traction device 2 firmly grips irregular shaped objects without breaking them and can be used with a variety of differently sized and shaped objects 4 without being modified. The object which is gripped by the traction device 4 may be something that a user wishes to pick-up or something that the user wishes to grip and turn such as a tap.

In this example, the object 4 is irregular and cannot be drawn wholly into the interior passage 14. However, if the object were smaller for example the size of the head portion 4*a* of the object 4, then it would be drawn wholly within into the interior passage 14. Once the object has been wholly drawn into the interior passage 14, the toroid body 10 regains its shape and the opening 12 formed by diverging portions 16*a*, 16*b* and 16*c* of the surface of the toroid body 10 re-forms and the traction device 2 is then able to pick up another object. Thus, the traction device 2 may be used to sequentially draw up a number of objects one after the other, each of the multiple objects being held in the interior passage 14 of the toroid body 10.

Figure 4:
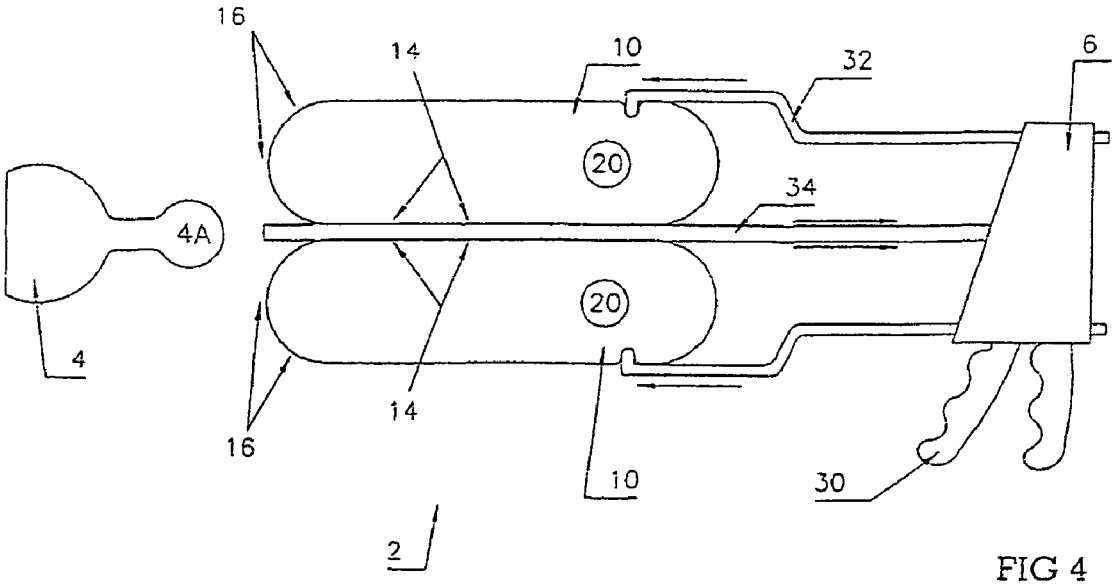
FIG. 4 shows an alternative embodiment of a traction device.

FIG. 4 illustrates a traction device 2 having an alternative actuator 6 which allows a user to be remote from the object 4. The actuator 6 comprises a manual control 30, an external frame 32 and an internal rod 34. The external frame 32 is coupled to the exterior of the toroid body 10 and the rod 34 is coupled to the interior passage 14 of the toroid body 10. According to one embodiment, when the manual control 30 is actuated, the external frame 32 of the actuator 6 is moved towards the object 4 (relative to the manual control 30) with the rod 34 remaining stationary (relative to the manual control 30). This pushes the external surface of the toroid body 10 towards the object 4. According to another embodiment, the external frame 32 remains stationary (relative to the manual control 30) while the rod 34 is moved away from the object 4 (relative to the manual control 30). This pulls the surface of the toroid body 10 in the interior passage 14 away from the object 4. The relative motions of the external frame 32 and the rod 34 cause the surface 16 of the toroid body 10 to roll about its supporting fluid 20 and to pick up the object 4. The manual control 30 may comprise gearing or a power source for operating the rod 34 and external frame 32.

Figure 5A:
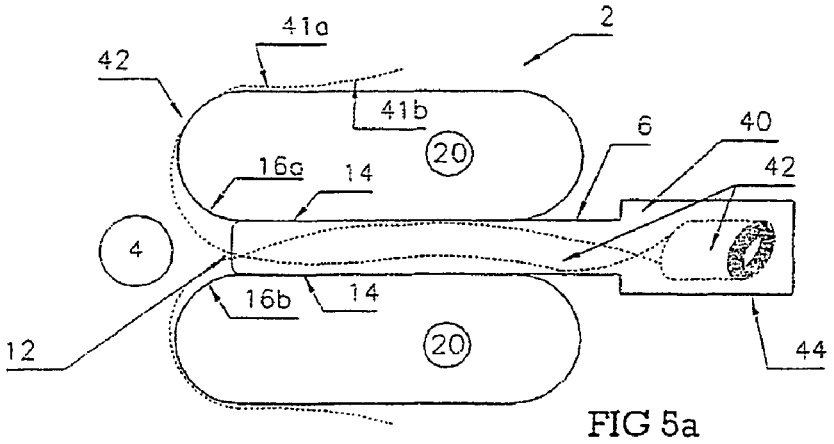
Figure 5B:
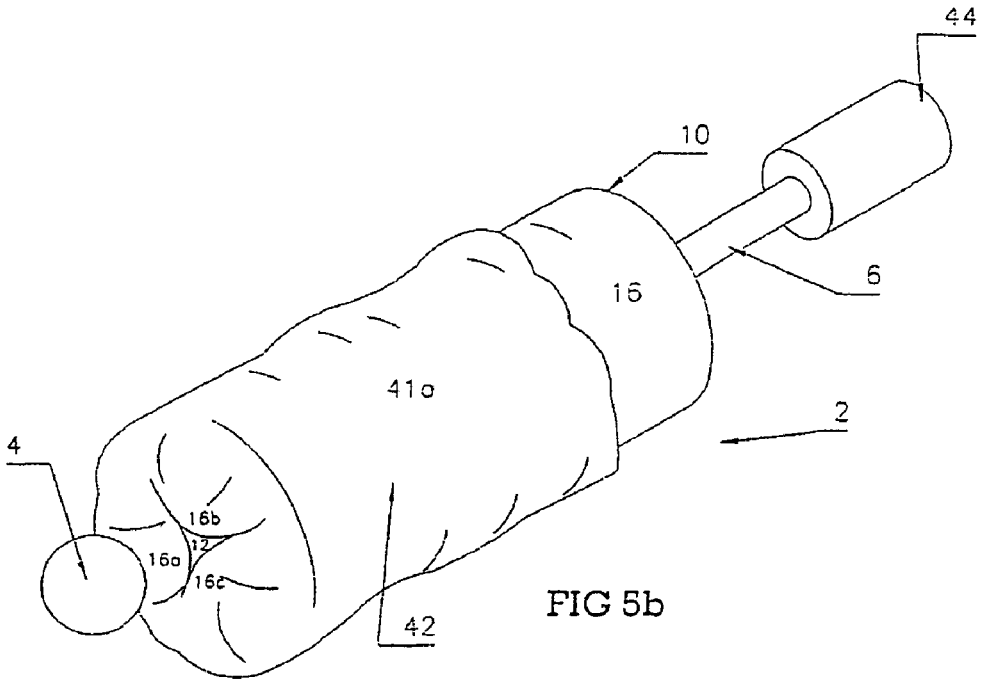
Figure 5C:
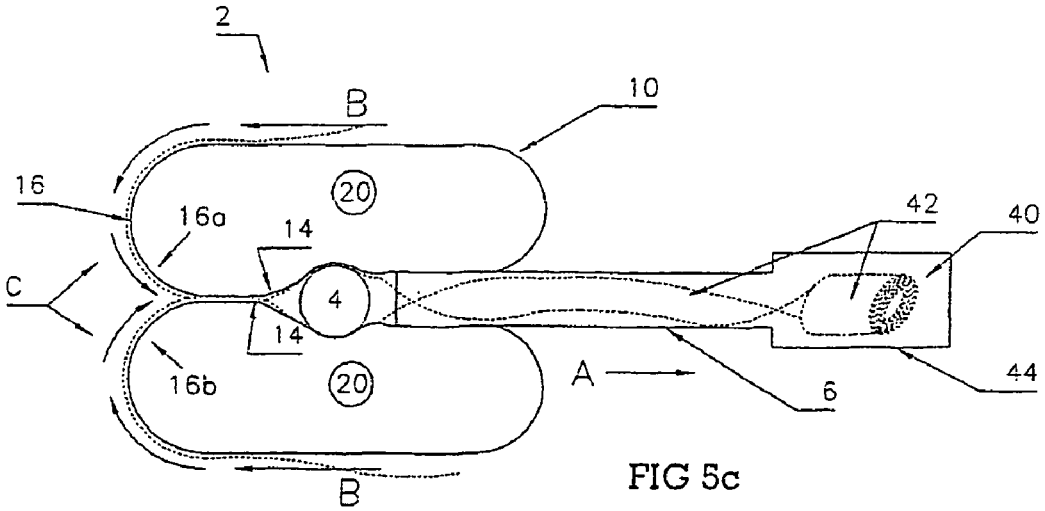

FIGS. 5*a*, 5*b*, 5*c*, 5*d* and 5*e* illustrate the use of the traction device 2 in bagging an object 4. In a particularly advantageous embodiment of the invention, the object 4 is animal faeces and the traction device 2 is used to collect and bag the animal faeces. FIGS. 5*a* and 5*b* illustrate a traction device 2 as previously described in relation to FIGS. 1 to 3. However, the actuator 6 in FIGS. 5*a* and 5*b* has been modified. The actuator 6 functions as a bag dispenser. There is a dispenser 40 of bags 42 in the handle 44 of the actuator 6. The dispenser holds a continuous tear-type roll of bags 42. A bag 42 is formed from a water impermeable, deformable material. The bag 42 is sized to fit snugly over the exterior of toroid body 10 and cover the opening 12 to the interior passage 14 as shown in FIG. 5*b*. The bag 42 is fitted inside out over the toroid body 10 so that its interior surface 41*a* is exposed to the object 4 and its exterior surface 41*b* makes contact with the diverging opposing surface portions 16*a*, 16*b* and 16*c* of the toroid body 10. The exterior surface 41*ab* preferably has surface irregularities, such as bumps or ribs, to increase its coefficient of friction against the object 4.

When the traction device 2 is used by pulling (arrow A) the actuator away from the object 4 and pushing (arrows B) the exterior surface 12 of the toroid body 10 towards the object 4, the surface 16 of the toroid body 10 rolls (arrows C) about the supporting fluid 20 and the bag 42 moves along with the surface 16 and is drawn into the interior passage 14. As the interior surfaces 41*a* of the bag 42 at the opening 12 are drawn inwards and upwards into the interior passage 14 of the toroid body 10 they grip the object 4 through the bag 42 and the object 4 and bag 42 move into the interior passage 14 bagging the object 4.

Figure 5D:
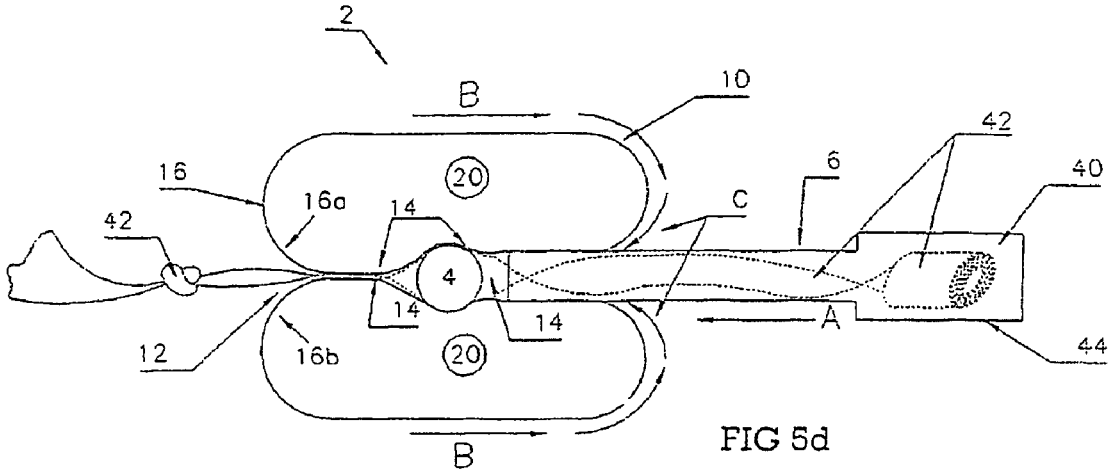

The portions of the bag 42 that still remain outside the interior passage 14, can be drawn together and tied into a knot as shown in FIG. 5*d*. Alternatively, the bag 42 can have adhesive portions on its interior surface 41*a*. In this case the bagged object 4 is drawn sufficiently far into the interior passage 14 so that the adhesive portions of the bag 42 are also drawn into the interior passage 14 where they come into contact and seal the bag 42.

Figure 5E:
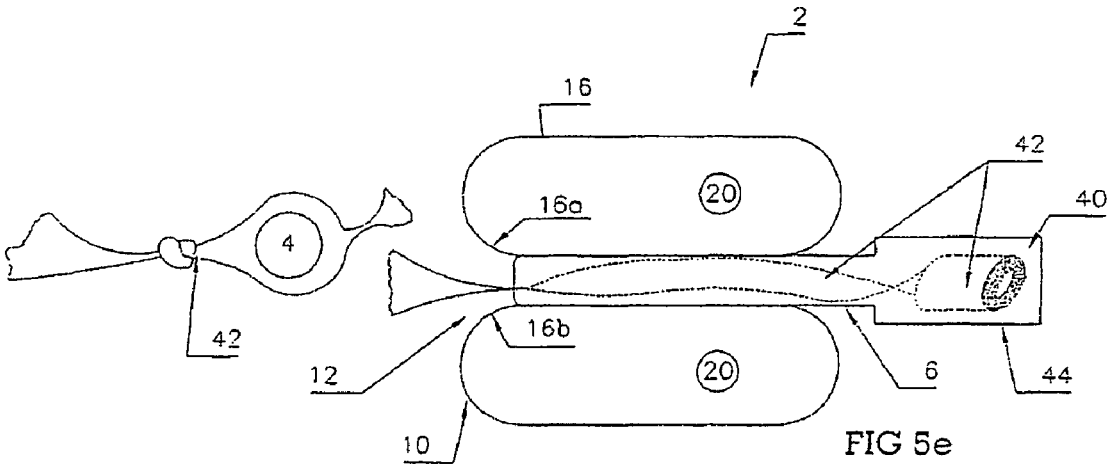

The bag can then be removed by pushing (arrow A?) the actuator 6 and pulling (arrows B?) the exterior surface if the toroid body 10. The surface 16 rolls (arrows C?) around the supporting fluid 20 and moves the bagged object 4 towards the opening 12 where it can be removed as shown in FIG. 5*e*.

Preferably the bag 42 on the exterior of the toroid body 10, is attached to the dispenser 40 of bags 42. As the bagged object is pulled away from the traction device 2 as shown in FIG. 5*e*, the next bag is drawn, via the hollow actuator 6, through the opening 12 of the toroid body 10. The user can therefore pull the next bag out from the dispenser 40 and place it over the exterior of the toroid body 10. Thus the traction device 2 is primed for picking up another undesirable object 4.

Another application of the traction device 2, is as a medical prosthesis. The prosthesis would provide for the picking up of an object 4 by, for example, the actuator 64 would be replaced by or attached to a limb.

Another application of the traction device 2 is in protectively packaging an object, for example, for delivery by postal services. The packaged object will be protected from damage during transit. in this example, the toroid body 10 is preferably filled with air and the actuator 6 is detachable. When the object 4, to be packaged, is drawn into the interior passage 14 of the toroid body 10, the actuator 6 is detached. Thus the object 4 is suspended within the toroid body 10 and held in position by the surface 16 forming the interior passage 14. Alternatively, the toroid body 10, without an actuator attached, is pushed over the object 4, and the surface 16 of the toroid body 10 rolls over the object 4 and draws it into the interior passage 14.

Figure 6A:
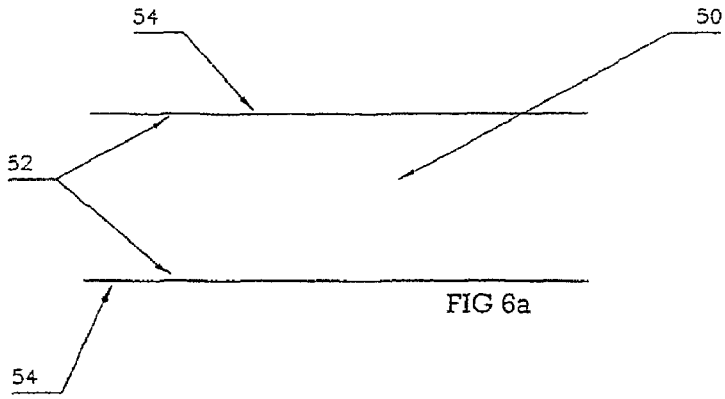
Figure 6B:
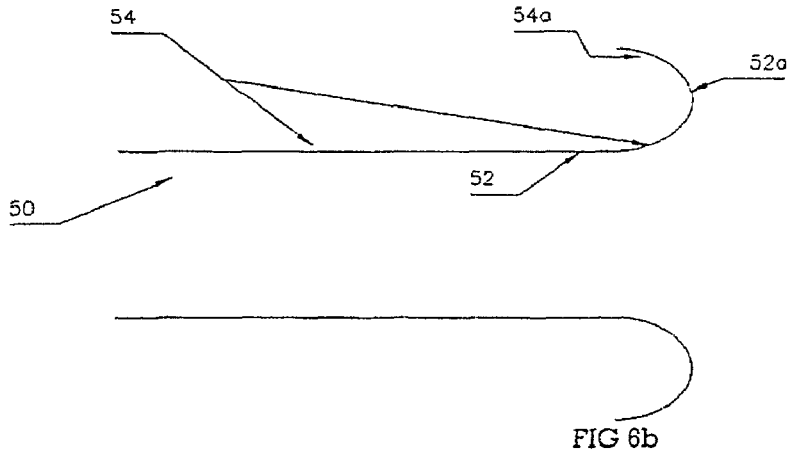
Figure 6C:
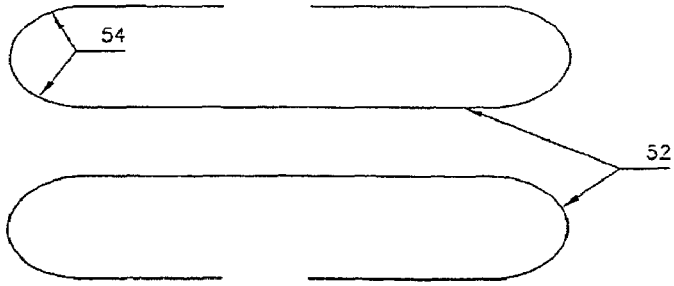
Figure 6D:
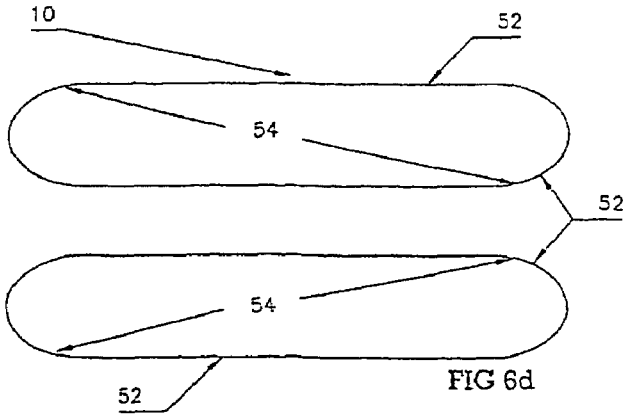

FIGS. 6*a*, 6*b*, 6*c* and 6*d* illustrate the manufacture of a toroid body 10. FIGS. 6*a* illustrates a tube 50 of deformable material. The tube 50 has an interior surface 52 and an exterior surface 54, an end portion of the tube 50 is turned inside out as illustrated in FIG. 6*b*. When the end portion of the tube is turned inside out, a portion 54*a* of the external surface 54 opposes the external surface 54 of the tube 50 and a portion 52*a* of the internal surface 52 of the tube 50 becomes an exterior surface. The other end of the tube 50 is also turned inside out as shown in FIG. 6*c* and the ends of the tubes are joined as shown in FIG. 6*d* to form the toroid body 10. Thus the exterior surface 16 of the toroid body 10 is formed from the interior surface 52 of the tube 50. The tube 50 is preferably cylindrical. Fluid is then supplied to the internal cavity of the toroid body 10 formed by the exterior surface 54 of the tube 50. The diameter of the tube is larger than the maximum width of the object 4 that the traction device is intended to be used with.

FIGS. 7 to 10 show another example of a traction device 102 according to the invention. Many of the features of the traction device 102 are similar to those previously described above and, therefore, similar features have been given the same reference numerals.

The traction device 102 includes a toroid body 10 and an actuator 6, the toroid body 10 having a continuous surface 16, the actuator 6 being coupled to the surface 16 to move the surface 16 as described above. The toroid body 10 is formed as described above so that the continuous surface 16 defines an internal cavity 21 which is filled with fluid.

The traction device 102 includes a plurality of projecting members 60, 62, 64, 66 (only a proportion of which have been labelled) which project from a portion 72 of the surface 16. The projecting members 60, 62, 64, 66 are in the form of fingers and are arranged in sets of three, the projecting members 60A, 60B, 60C forming one set, the projecting members 62A, 62B, 62C forming another set and so on. Referring to FIG. 10B and using the set of projecting members 62A, 62B, 62C as an representative example, each of the projecting members 62A, 62B, 62C is spaced equally radially around the longitudinal axis 8 of the traction device 102. Referring to FIGS. 7 to 9, each of the sets of projecting members 60, 62, 64, 66 are spaced apart from each other along the length of the surface 16. Each projecting member of each of the sets 60, 62, 64, 66 extends from substantially the same axial region of the surface 16 along the axis 8, although the members of each set are slightly off-set axially from each other.

The projecting members 60, 62, 64, 66 are aligned axially along the surface 16 so that, for example, projecting members 60A, 62A, 64A, 66A are aligned in a row, which for convenience will be termed row A. Thus the projecting members in FIG. 7 are aligned in three axial rows A, B, C.

As the surface 16 moves into the interior, it deforms to form creases 70 as shown in FIGS. 7 and 10B. FIG. 10A shows a cross sectional view from one end of the of a surface portion 72 of the toroid body 10, the surface portion 72 including a plurality of thicker regions 74 and thinner regions 76, the thinner regions 76 being regions where the thickness of the material of the surface portion 72 is thinner relative to the thickness of the surface material in the thicker regions 74. The thinner regions 76 are elongate and extend axially along the surface portion 72, substantially equally spaced between the rows A, B, C of the projecting members 60, 62, 64, 66, so that the rows A, B, C and thinner regions 76 are located alternately radially around the surface portion 72. The surface portion 72 could form only part of the continuous surface 16.

FIGS. 8 and 9 show the traction device 102 in use. The traction device 102 is moved towards an object 4 until diverging opposing surface portions 16A, 16B at the opening 12 are close to or touch the object 4. The traction device 102 is operated in a similar manner to that described in the previous embodiments to draw the object 4 into the interior passage 14, the actuator 6 being moved away from the object 4 as indicated by arrows A so that the surface 16 rolls around and into the opening 12. As the actuator 6 moves the surface 16, the projecting members 60 move towards the object 4, each projecting member corresponding with at least one other projecting member to engage the object 4 and draw the object 4 into the interior passage 14. It will be noted that in this embodiment, contact between the surface 16 and the object 4 is not required to draw the object 4 into the interior.

The thinner regions 76 of the surface portion 72 control the location of the creases 70 formed as the surface portion 72 moves into the opening 12, and thus, also control the positioning of the projecting members 60, 62, 64, 66 as these projecting members move into the inner passage 14, so that the action of the projecting members is consistent and repeatable.

The projecting members 60, 62, 64, 66 could be formed of a resiliently deformable material, so that the projecting members can deform around the object 4.

In one example, the surface 16 and projecting members 60, 62, 64, 66 are formed integrally by moulding of a rubber material. The rubber material could be an natural rubber material. A range of different hardnesses could be used. A good combination of stiffness with flexibility is provided by materials of shore hardness in the range 40 to 55, and optimally in the range 45 to 50. Stiffer materials of higher shore hardness have longer lasting wear characteristics but are harder to deform and therefore more effort is required by a user to use the traction device.

In one particular example, the traction device 102 is a device for collecting dog faeces, although the device can equally be used for collecting or picking other objects. In this example, the toroid body 10 has an outside diameter of approximately 80 mm with three rows of projecting members equally spaced around the surface portion 72. The projecting members are conical in form, having a base diameter of approximately 10 mm and projecting approximately 17 mm from the surface portion 72. Each projecting member (for example, 60A, 60B, 60C) within each set (for example, 60) is off-set axially from neighbouring projecting members by approximately 2 mm to 5 mm so that as the projecting members move together and towards each other into the interior passage 14, each projecting member of a set comes into contact with at least one other member of the same set as shown in FIG. 10B. However, the slight axial offset between the projecting members helps prevent damage caused by contact between the projecting members of a set. The surface portion 72 is approximately 1.6 mm in thickness in the thicker regions 74, and 0.8 mm in thickness in the thinner regions 76, which form bands approximately 16 mm wide running axially.

The axial spacing between the sets of projecting members is approximately 25 mm. Depending on the size of the object 4, successive objects can be drawn into the interior 14 between the sets 60, 62, 64, 66 of the projecting members.

Various other modifications of this embodiment could be made without departing from the scope of the invention. The projecting members could be arranged differently, for example, randomly or in a spiral.

FIG. 11 shows a traction device 202 having similar features to that of the traction devices previously described but in which the projecting members 60, 62, 64, 66 are arranged in four rows A, B, C, D. The surface portion 72 in this embodiment as shown in FIG. 11 includes four regions of thinner material 76 and four thicker regions 74, the thinner regions 76 being elongate, running axially along the surface portion 72 and being equally spaced between the rows A, B, C, D.

Similarly, FIG. 12 shows a traction device 302 having five equally spaced rows A, B, C, D, E of projecting members 60, 62, 64, 66, the surface portion 72 comprising five thinner regions 76 and five thicker regions 74, the thinner regions 76 being equally spaced between the rows A, B, C, D, E.

Although in these embodiments the rows of the projecting members and the thinner regions 76 are shown as being equally spaced, it would also be possible to vary the spacing to suit particular applications.

The size and form of the projecting members 60, 62, 64, 66 could be varied. It will be noted that in FIG. 10B the projecting members 60A, 60B, 60C overlap in the interior passage 14, but that this is not the case in FIG. 11B in which the projecting members 60A, 60B 60C, 60D are of a set could be spaced apart from each other in the interior passage 14. In the embodiment shown in FIG. 12B, the projecting members 60, 62, 64, 66 are relatively longer and project towards and are received within the creases 70 in the interior passage 14, overlapping each other. The thinner regions 76 allow control of the location of the creases 70 so that during operation the risk of damage or wear to the projecting members 60, 62, 64, 66 by contact with the surface of the interior passage 14 is minimised. In one example, it has been found that the projecting members are advantageously between 5 mm and 40 mm in length and optimally between 15 mm and 20 mm in length.

It will be noted that those embodiments having an odd number of rows/creases e.g. as shown in FIGS. 10 and 12, permit longer projecting members in comparison with embodiments having an even number of rows/creases e.g. as shown in FIG. 11, as the odd number permits the projecting members to extend towards and be received within the opposite crease.

The projecting members could be of any suitable size, shape or form. Some examples of the form of the projecting members are shown in FIG. 13. The projecting members could be conical (reference numeral 60 as described above), pyramidal 91, L-shaped 90, T-shaped 94, forked 92, 96, or cylindrical 98. Different forms of projecting members could be used in combination. The projecting members could be formed separately to the surface material and removably mounted to the surface material, allowing different combinations of projecting members according to requirements.

The different forms of projecting members could be suitable for different applications. For example, the conical 60, 62, 64, 66, pyramidal 91, L-shaped 90 or cylindrical 98 forms could be suitable for combing through vegetation such as grass. The T-shaped 94 or forked 92, 96 forms could be suitable for collecting relatively soft materials such as faeces off flat, relatively smooth surfaces, as these forms act as scoops.

FIGS. 14A, 14B, 14C, 14D show the traction device 102 being used with a bag 42 to bag the object 4 in a similar manner to that described previously. The bag 42 is loosely laid over the projecting members 60, 62, 64, 66 and the traction device 102 operated to draw the object 4 into the interior passage 14. The bag 42 is sufficiently loose so that the projecting members 60, 62, 64, 66 do not pierce the bag 42. With the object 4 in the interior passage 14 of the traction device 102, as shown in FIG. 14C, a knot 46 is tied in the bag 42. The actuator 6 is then operated in a reverse direction as shown by arrow C to move the surface 16 as shown by arrows D to eject the bagged object 4 from the interior passage 14.

The projecting members are particularly advantageous when picking up material which may otherwise simply smear over the surface 16, such as soft faeces, and also objects which are relatively thin and/or flat, e.g. a credit card lying on a flat surface. In the case of the soft faeces, the projecting members act together to scoop under the faeces to draw the faeces up into the interior passage. In the case of a relatively thin, flat object such as a credit card, the projecting members are able to pick under an edge of the card to lift the card into the interior of the traction device.

FIG. 15 shows another example of a traction device 202 according to the invention. Many of the features of the traction device 202 are similar to those previously described above and therefore similar features have been given the same reference numerals.

The traction device 202 includes a toroid body 10 and an actuator 6, the toroid body 10 having a continuous surface 16. The toroid body 10 is constructed in a similar manner to that previously described, and the actuator is coupled to the surface 16 to move the surface 16 in a manner as previously described.

The traction device 202 includes a plurality of projecting members 260, 262, 264, 266 (only a proportion of which have been labelled) which project from a portion of the surface 16. In this embodiment, the projecting members 260, 262, 264, 266 are in the form of surface irregularities which in this example are bumps but could take the form of ribs or some other similar form, or some combination thereof. The projecting members 260, 262, 264, 266 could, in this example, project less than 5 mm from the surface 16. In other respects, the arrangement of the projecting members 260, 262, 264, 266 is similar to that as previously described for the embodiment of FIGS. 7 ? 10, the projecting members being arranged in sets 260, 262, 264, 266 and rows A, B and C.

In use, the projecting members 260, 262, 264, 266 increase the coefficient of friction of the surface 16, thus improving the gripping/picking capability of the traction device 202.

Other forms of projecting member can be envisaged such as rounded bumps or studs.

Other modifications may be made within the scope of the invention. Any of the features of any of the embodiments described could be combined in any suitable combination.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A traction device, for drawing an object into its interior, comprising a surface of deformable material, shaped substantially as a tube with an end portion turned inside-out and forming an opening to an interior, an actuator for moving the surface to draw the object into the interior, the device including a plurality of projecting members, which project from the surface to engage the object, the surface material including a the thinner regions being associated with the locations of creases formed when the surface moves into the interior.

2. A traction device as claimed in claim 1 comprising a toroid made from deformable material and providing the surface.

3. A traction device as claimed in claim 2, wherein the toroid is filled with fluid.

4. A traction device as claimed in claim 1, wherein each projecting member is arranged to correspond with another projecting member as the surface is moved into the interior.

5. A traction device as claimed in claim 1, wherein the projecting members are arranged in a plurality of spaced sets, each set including a plurality of projecting members which correspond together as the surface is moved into the interior.

6. A traction device as claimed in claim 5, wherein the projecting members of each set are spaced radially around the surface.

7. A traction device as claimed in claim 5, wherein each projecting member of each set comes into contact with at least one other member of the same set as the surface moves into the interior.

8. A traction device as claimed in claim 1, wherein each projecting member is conical in shape, tapering from the surface to a tip.

9. A traction device as claimed in claim 1, wherein each projecting member is pyramidal, cylindrical, forked, L-shaped or T-shaped.

10. A traction device as claimed in claim 1, wherein the projecting members are substantially aligned in rows along the surface, and the rows of the projecting members and the thinner regions are located alternately radially around the surface and spaced substantially equidistantly from each other so that the creases locate substantially equidistantly between the rows of projecting members.

11. A traction device as claimed in claim 10, wherein in the thinner regions, the surface material is approximately half the thickness of the surface material in the thicker regions.

12. A traction device as claimed in claim 1, wherein the projecting members are in the form of fingers and project between 5 mm and 40 mm from the surface.

13. A traction device as claimed in claim 1, wherein the projecting members are in the form of surface irregularities such as bumps or ribs, and project less than 5 mm from the surface.

14. A method of picking or gripping an object using a traction device as claimed in claim 1, comprising the steps of placing the opening of the traction device near to the object, and operating the actuator of the traction device to draw the object into the interior.

15. A method of bagging an object such as faeces, comprising the method as claimed in claim 14, but further including the step of placing a bag over the surface between the opening and the object before operating the traction device to draw the object and the bag into the interior.

* * * * *

UNITED STATES PATENT AND TRADEMARK OFFICE

CERTIFICATE OF CORRECTION

PATENT NO. : 7,726,716 B2
APPLICATION NO. : 11/320256
DATED : June 1, 2010
INVENTOR(S) : Gary Shuttleworth It is certified that error appears in the above-identified patent and that said Letters Patent is hereby corrected as shown below:

Col. 11, line 52, claim 1, line 8 should read "plurality of thicker regions and thinner regions, the location of the thinner regions being associated with the location of"

Signed and Sealed this

Thirteenth Day of July, 2010

David J. Kappos

David J. Kappos
*Director of the United States Patent and Trademark Office*